US012618238B1

(12) United States Patent
Russo

(10) Patent No.: US 12,618,238 B1
(45) Date of Patent: May 5, 2026

(54) CEILING SYSTEM FOR CLEANROOMS

(71) Applicant: Domenic Russo, Dover, MA (US)

(72) Inventor: Domenic Russo, Dover, MA (US)

(73) Assignee: FH CHASE INC., Taunton, MA (US)

( * ) Notice: Subject to any disclaimer, the term of this patent is extended or adjusted under 35 U.S.C. 154(b) by 393 days.

(21) Appl. No.: 17/970,723

(22) Filed: Oct. 21, 2022

(51) Int. Cl.
*E04B 9/20* (2006.01)
*E04B 9/06* (2006.01)
*E04B 9/12* (2006.01)

(52) U.S. Cl.
CPC ..... *E04B 9/20* (2013.01); *E04B 9/127* (2013.01); *E04B 9/064* (2013.01)

(58) Field of Classification Search
CPC . E04B 9/064; E04B 9/127; E04B 9/18; E04B 9/20
See application file for complete search history.

(56) References Cited

U.S. PATENT DOCUMENTS 4,748,789 A 6/1988 Hedley
5,313,759 A * 5/1994 Chase, III ..... E04B 9/18 52/39
5,349,800 A * 9/1994 Peng ..... E04B 9/18 403/174
6,511,522 B1 * 1/2003 Gomez ..... E04B 9/20 52/302.1
10,590,649 B1 * 3/2020 Morrison ..... E04B 9/20
12,031,327 B1 * 7/2024 Laydera-Collins ..... E04B 9/183
2003/0213199 A1 * 11/2003 Bongio ..... E04B 9/183 52/506.07
2008/0216431 A1 * 9/2008 McGee ..... E04B 9/064 52/506.09
2012/0240495 A1 * 9/2012 Eychaner ..... E04B 9/20 52/506.07

FOREIGN PATENT DOCUMENTS

CA 2377819 A1 * 7/2002
EP 0627532 A1 * 12/1994

* cited by examiner

*Primary Examiner* — Christine T Cajilig
(74) *Attorney, Agent, or Firm* — Bryan L. Loeffler, Esq.; LOEFFLER IP GROUP, P.A.

(57) ABSTRACT

A ceiling for a cleanroom that is easily adaptable to a variety of ceiling types found in envelope buildings and adaptable to support the placement of heavy loads above the cleanroom ceiling and/or suspended below the cleanroom ceiling.

1 Claim, 7 Drawing Sheets

CEILING SYSTEM FOR CLEANROOMS

FIELD OF THE INVENTION

The present invention relates to cleanrooms, and more particularly, to a suspended ceiling system having modular components that allow the suspended ceiling system to be easily adapted to a variety of envelope buildings for supporting a variety of loads regardless of weight or location above the ceiling.

BACKGROUND OF THE INVENTION

Cleanrooms are engineered spaces wherein the temperature, humidity, cleanliness, concentration of airborne particulates, and air pressure are controlled. These factors make cleanrooms useful in highly technical industries, such as the semiconductor industry, the medical device industry, the pharmaceutical industry, and the nano technology industry.

Most cleanrooms are designed to be contained within a larger envelope building, which houses and protects the cleanroom from weather and the outdoors. The envelope building also protects utility and environmental systems that are commonly mounted on top of the cleanroom in the interstitial space between the ceiling of the cleanroom and the ceiling of the envelope building.

Each cleanroom has its own unique requirements and specifications for carrying various weights, such as deadloads of heavy cleanroom components, such as utility systems, environmental systems, automated material handling systems (AMHS), robotics tracks, fan filter units (FFUs), ducted filters, light fixtures, non-walkable blank panels, walkable panels, and so forth. The configuration and layout of a cleanroom ceiling and its components may vary greatly depending on various factors, such as the structure of the envelope building, the location of the cleanroom, and so forth, thereby making the placement and structure of ceiling supports vary from job to job.

Therefore, a need exists for a suspended ceiling system that having modular components that allow the suspended ceiling system to be easily adapted to a variety of envelope buildings and to support a variety of loads regardless of placement above the ceiling

SUMMARY OF THE INVENTION

The primary object of the present invention is to provide a ceiling for a cleanroom that is adaptable to a variety of ceiling types found in envelope buildings.

An additional object of the present invention is to provide a ceiling system for a cleanroom that is modular and, thus, adaptable to support a variety of heavy loads placed above the cleanroom ceiling and/or suspended below the cleanroom ceiling.

The present invention achieves the above and other objects by providing a modular type walkable ceiling system having a support grid that is suspended from a main ceiling using turnbuckle leveling suspension systems and support brackets that are easily positioned to accommodate different weight loads and ceiling configurations.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
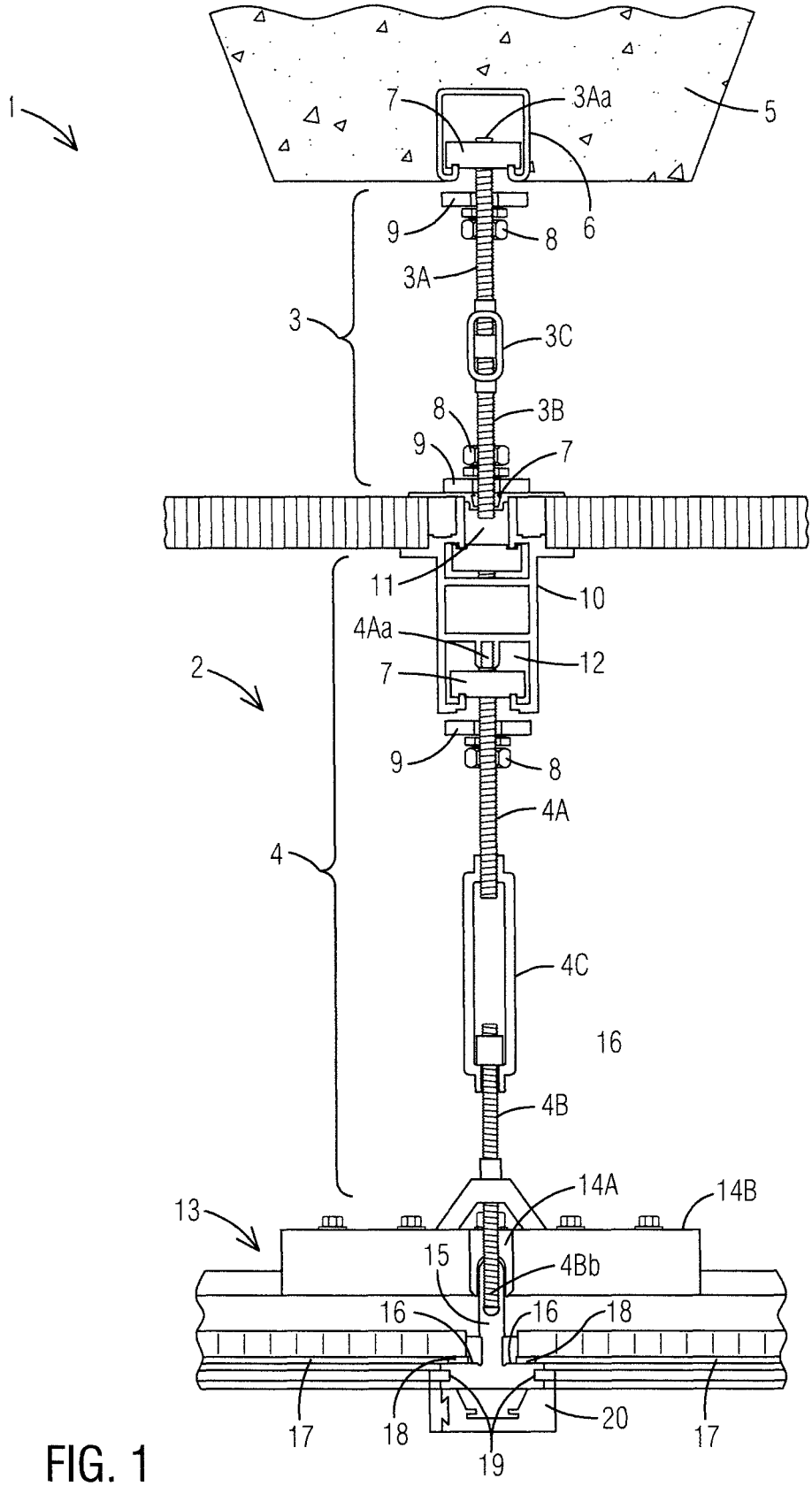
FIG. 1 is a sectional side view of a cleanroom ceiling system and a suspension assembly of the present invention.

For purposes of describing the preferred embodiment, the terminology used in reference to the numbered accessories in the drawings is as follows:

1. cleanroom ceiling system, generally
2. suspension assembly
3. upper leveling assembly
3A. upper threaded rod
3Aa. top end of upper threaded rod
3B. lower threaded rod
3Bb. bottom end of lower threaded rod
3C. turnbuckle
4. lower leveling assembly
4A. upper threaded rod
4Aa. top end of lower threaded rod
4B. lower threaded rod
4Bb. bottom end of lower threaded rod
4C. turnbuckle
5. main ceiling
6. strut
7. sliding nut
8. locking nut
9. washer
10. plenum cap
11. top channel
12. bottom channel
13. grid support assembly
14. joint connector
14A. full/split crossover connector
14B. upper crossover connector

14C. sprinkler hub crossover connector
15. ceiling grid
15A. extruded beam
16. ledge
17. ceiling blank
18. gasket
19. attachment slot
20. utility clip
20A. first interlocking side of utility clip
20B. second interlocking side of utility clip
21. body of full/split crossover connector
22. top surface of full/split crossover connector
23. bottom surface of full/split crossover connector
24. side surface of full/split crossover connector
25. end of full/split crossover connector
26. U-shaped groove
27A. aperture
27B. central aperture
27C. sprinkler clearance hole
28. threaded fastener
29. anchoring channel
30. screw slot extrusion
31. reinforcing bar
32. screw
33. dovetail joint
34. eye bolt
35. dowel nut aperture
36. dowel nut With general reference to FIG. 1, a sectional side view of a cleanroom ceiling system 1 and a suspension assembly 2 thereof are illustrated. The suspension assembly 2 comprises an upper leveling assembly 3 and a lower leveling assembly 4 with each having upper threaded rods 3A, 4A and a lower threaded rod 3B, 4B connected by a turnbuckle 3C, 4C that allow the heights of the upper leveling assembly 3 and the lower leveling assembly 4 to be independently adjusted.

The suspension assembly 2 is supported by a main ceiling 5 of an outer envelope building that houses the cleanroom, which may be a concrete ceiling, steel I-beam ceiling, underside of a slab, roof deck, upper floor, or other equivalent structure. As illustrated in FIG. 1, the main ceiling 5 is a concrete waffle slab having an embedded strut 6 with a U-shaped channel. A top end 3Aa of the upper threaded rod 3A is secured to the strut 6 by a sliding nut 7 that allows the top end 3Aa of the upper threaded rod 3A to slide along the length of the strut 6 and to be locked into position using at least one locking nut 8 and washer 9 that engage the upper threaded rod 3A.

A bottom end 3Bb of the lower threaded rod 3B is secured to a plenum cap 10 having a top channel 11 that engages a second sliding nut 7 that is also secured to the bottom end 3Bb of the lower threaded rod 3B, thereby allowing the bottom end 3Bb of the lower threaded rod 3A to slide along the length of the top channel 11 and the plenum cap 10. The bottom end 3Bb of the lower threaded rod 3B may be locked into position on the top channel 11 using at least one locking nut 8 and washer 9 that engage the lower threaded rod 3B of the upper leveling assembly 3.

In addition to having a top channel 11, the plenum cap 10 comprises a bottom channel 12 that supports a top end 4Aa of the upper threaded rod 4A of the lower leveling assembly 4 is connected to the bottom channel 12 by a sliding nut 7 that allows the top end 4Aa of the upper threaded rod 4A to slide along the length of the bottom channel 12 and to be locked into position using at least one nut 8 and washer 9 that engage the upper threaded rod 4Aa of the lower leveling assembly 4.

Certain applications will not require an upper leveling system 3 or plenum support 10. In such applications, a top end 4Aa of the upper threaded rod 4A of the lower leveling assembly 4 is connected directly to the strut 6. A bottom end 4Bb of the lower threaded rod 4B is secured to a grid support assembly 13 comprising a ceiling grid 15 having T-shaped beams 15A that intersect to form an X-shaped joint that is secured using a full/split crossover connector 14A and a double crossover joint connector 14B that connect to each other and to the X-shaped joint.

The beams 15A preferably have an inverted T-shape or L-shape that provides one or more ledges 16 for supporting edges of walkable or non-walkable ceiling blanks 17, light panels, air vents, etc. A gasket 18 preferably lines an upper surface of the ledges 16 to provide an airtight seal between the ceiling grid 15 with the ceiling blanks 17.

Figure 11:
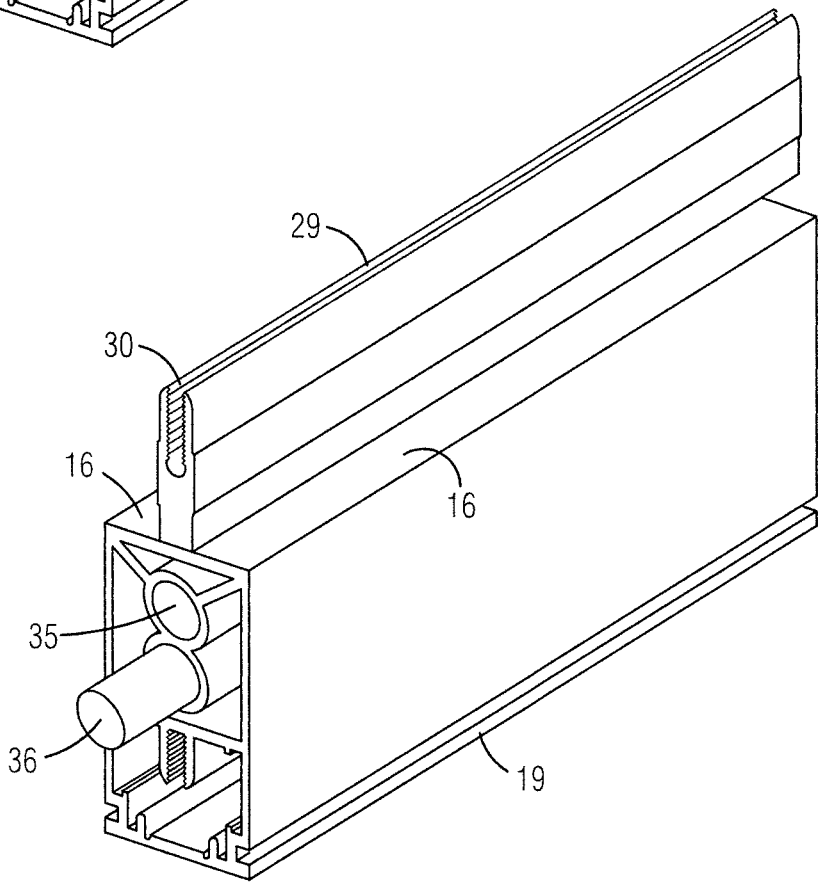
FIG. 11 is a perspective side view of an extruded ceiling support bracket having a tubular connector plate.

The ceiling grid 15 is constructed of multiple primarily T-shaped beams 15A having opposing side surfaces that extend below the ledges 16 where side attachment slots 19 for utility and partition clips or channeled grooves are located. The side attachment slots 19 engage a utility clip 20 that provides hanging support for accessories within the cleanroom, as illustrated in FIG. 11.

Figure 2:
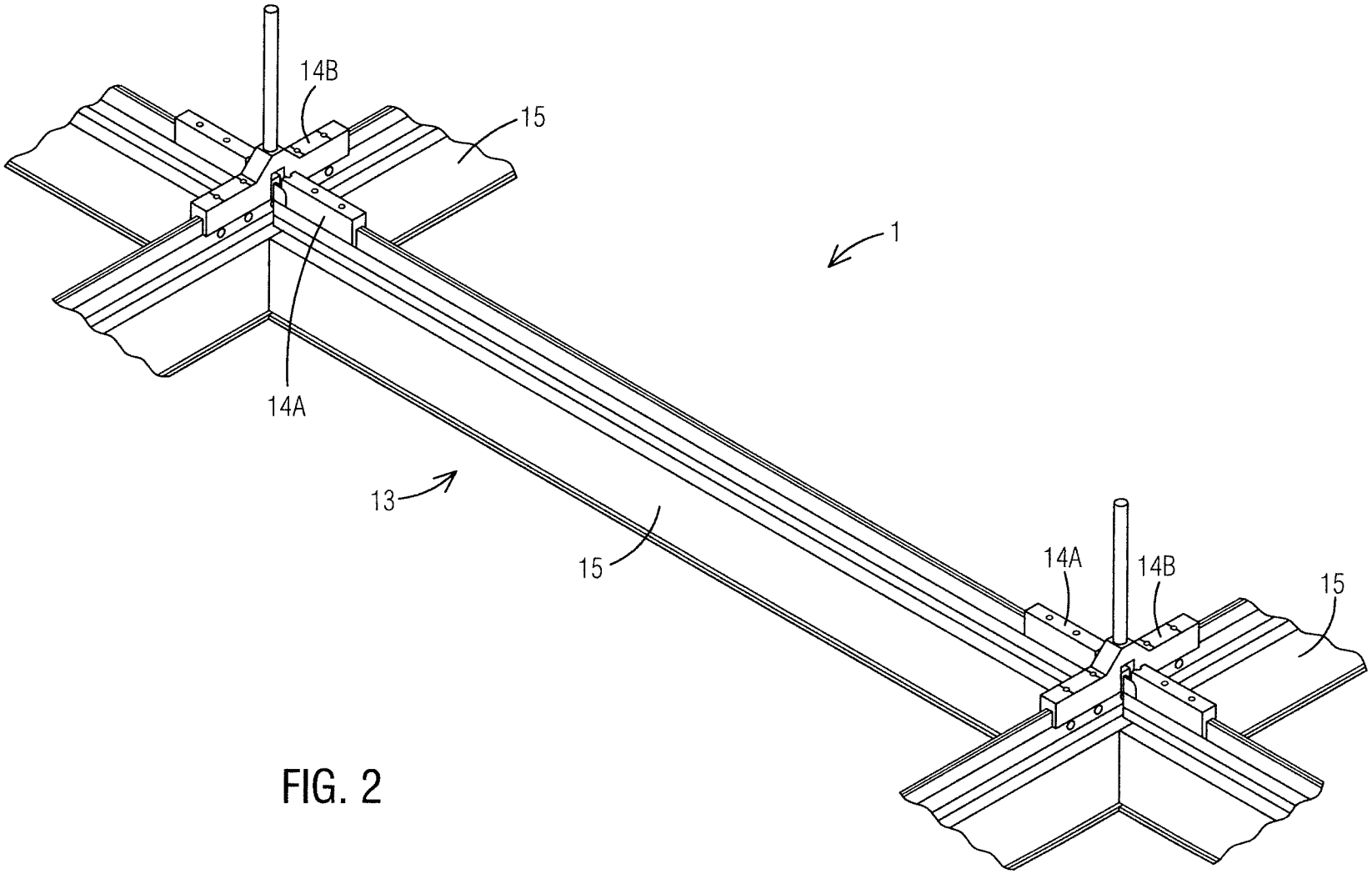
FIG. 2 is a perspective view of a cleanroom ceiling system of the present invention and a grid support assembly thereof supported by multiple suspension assemblies.

With general reference to FIG. 2, a perspective view of a cleanroom ceiling system 1 of the present invention and a grid support assembly 13 thereof supported by multiple suspension assemblies 2 are illustrated.

Figure 5:
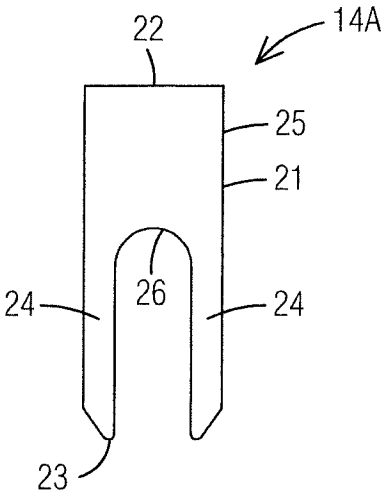
FIG. 5 is an end view of a full/split crossover connector of the present invention.
Figure 3:
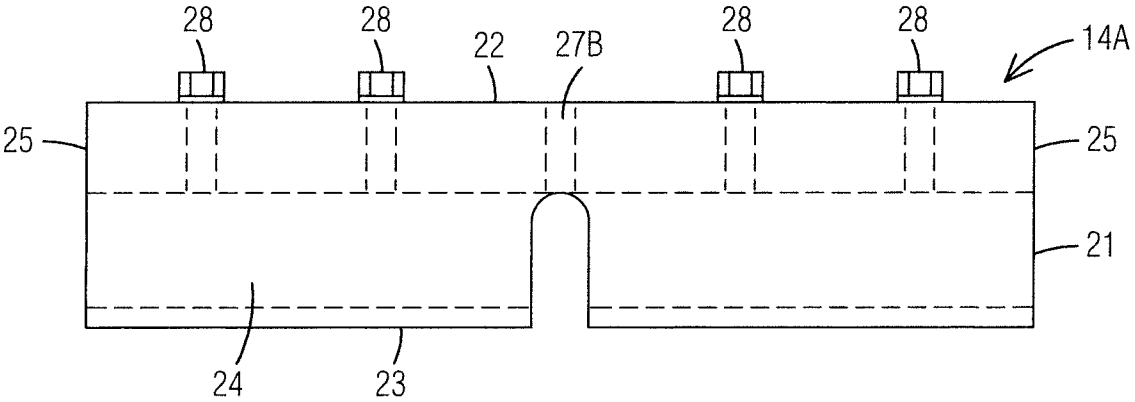
FIG. 3 is a side plan view of full/split crossover connector of the present invention.
Figure 4:
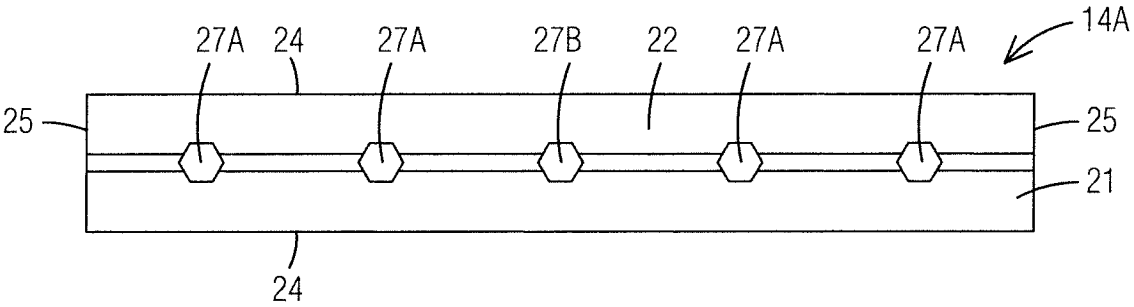
FIG. 4 is a top plan view of full/split crossover connector of the present invention.

As illustrated in FIGS. 3-5, a full/split crossover connector 14A of the present invention is illustrated. The grid support assembly 13 supports a ceiling grid 15 by using joint connectors 14. The full/split crossover connector 14A comprises an elongated rectangular-shaped body 21 having a top surface 22, a bottom surface 23, side surfaces 24, and ends 25. An inverted U-shaped groove 26 extends into the bottom surface 23 and runs the length of the body 21. A preferably odd number of apertures 27A are spaced evenly apart on the top surface 20 of the body 21 with a central aperture 27B being connectable to the bottom end 4BB of the lower threaded rod 4B, as illustrated in FIG. 1. The remaining apertures 27A accept threaded fasteners 28, such as bolts, that pass through the remaining apertures 27A to engage the ceiling grid 15. The threaded fasteners 28 engage an anchoring channel 29 having an inverted U-shape formed by two opposing walls and screw slot extrusions 30 lining an inner surface thereof. The threaded fasteners 28 engage the screw slot extrusions 30, which act as threads within the anchoring channel 29 to maintain a screw slot firm grip on the fastener 28 thereby locking the two elements together.

Figure 8:
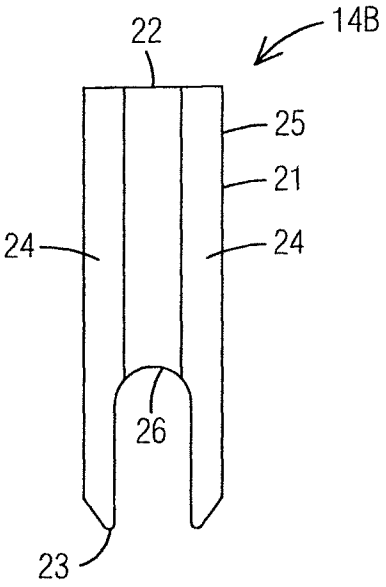
FIG. 8 is an end view of a double crossover connector of the present invention.
Figure 6:
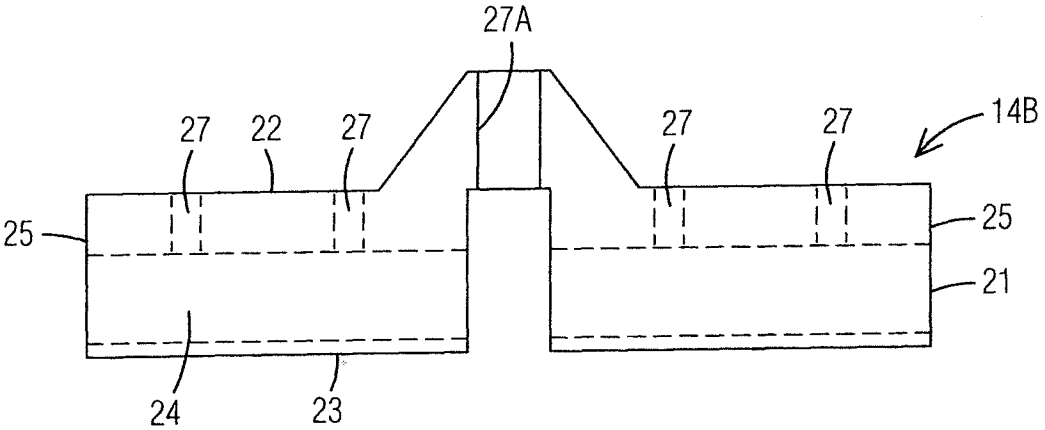
FIG. 6 is a side plan view of a double crossover joint connector of the present invention.
Figure 7:
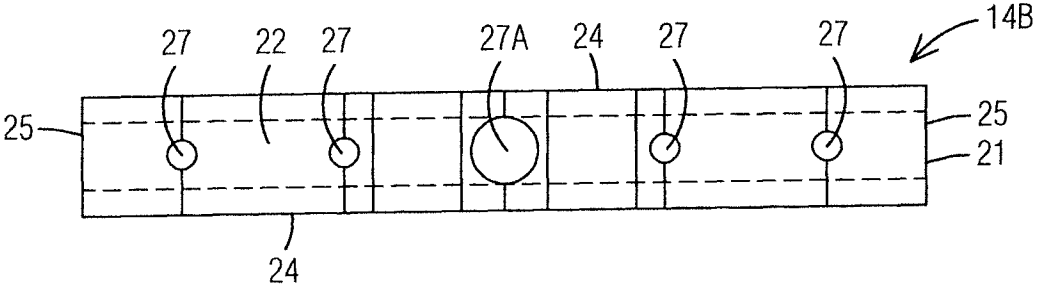
FIG. 7 is top view of a double crossover connector of the present invention.

As illustrated in FIGS. 6-8, a double crossover connector 14B of the present invention is illustrated. Like the full/split crossover connector 14A illustrated in FIGS. 3-5, the upper crossover connector 14B comprises an elongated rectangular-shaped body 21 having a top surface 22, a bottom surface 23, side surfaces 24, and ends 25. An inverted U-shaped groove 26 extends into the bottom surface 23 and runs the length of the body 21. A preferably odd number of apertures 27A are spaced evenly apart on the top surface 20 of the body 21 with a central aperture 27B. However, the upper double crossover connector 14B further comprises a raised center portion 30 located under the central aperture 27B, wherein the raised center portion provides a gap 32 that allows the double crossover joint connector 14B to be connected to the full/split crossover connector 14A to form an X-shape for connecting intersecting joints of a ceiling grids 15, as illustrated in FIG. 2.

Figure 8A:
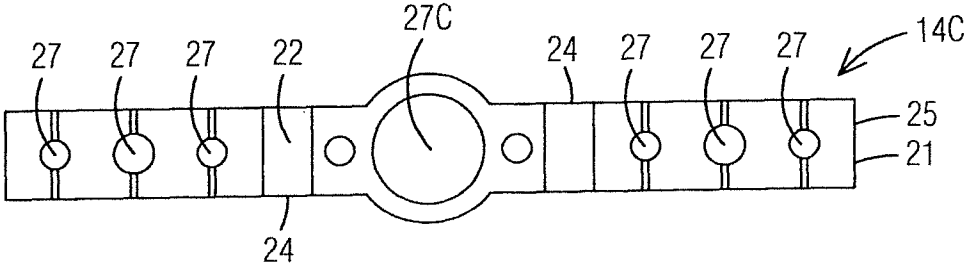
FIG. 8A is a top view of sprinkler hub crossover connector of the present invention with a central aperture having a diameter large enough to accommodate a sprinkler head.

As illustrated in FIG. 8A, a top view of a sprinkler hub crossover connector 14C of the present invention with a sprinkler clearance hole 27C to accommodate a sprinkler head. The sprinkler clearance hole 27C has a larger diameter for accommodating a sprinkler head and any attached plumbing, hose, tubing, etc., thereby allowing the sprinkler hub crossover connector 14C to be used as an attachment bracket for securing sprinkler heads and related plumbing anywhere on the ceiling grid 15.

Figure 9:
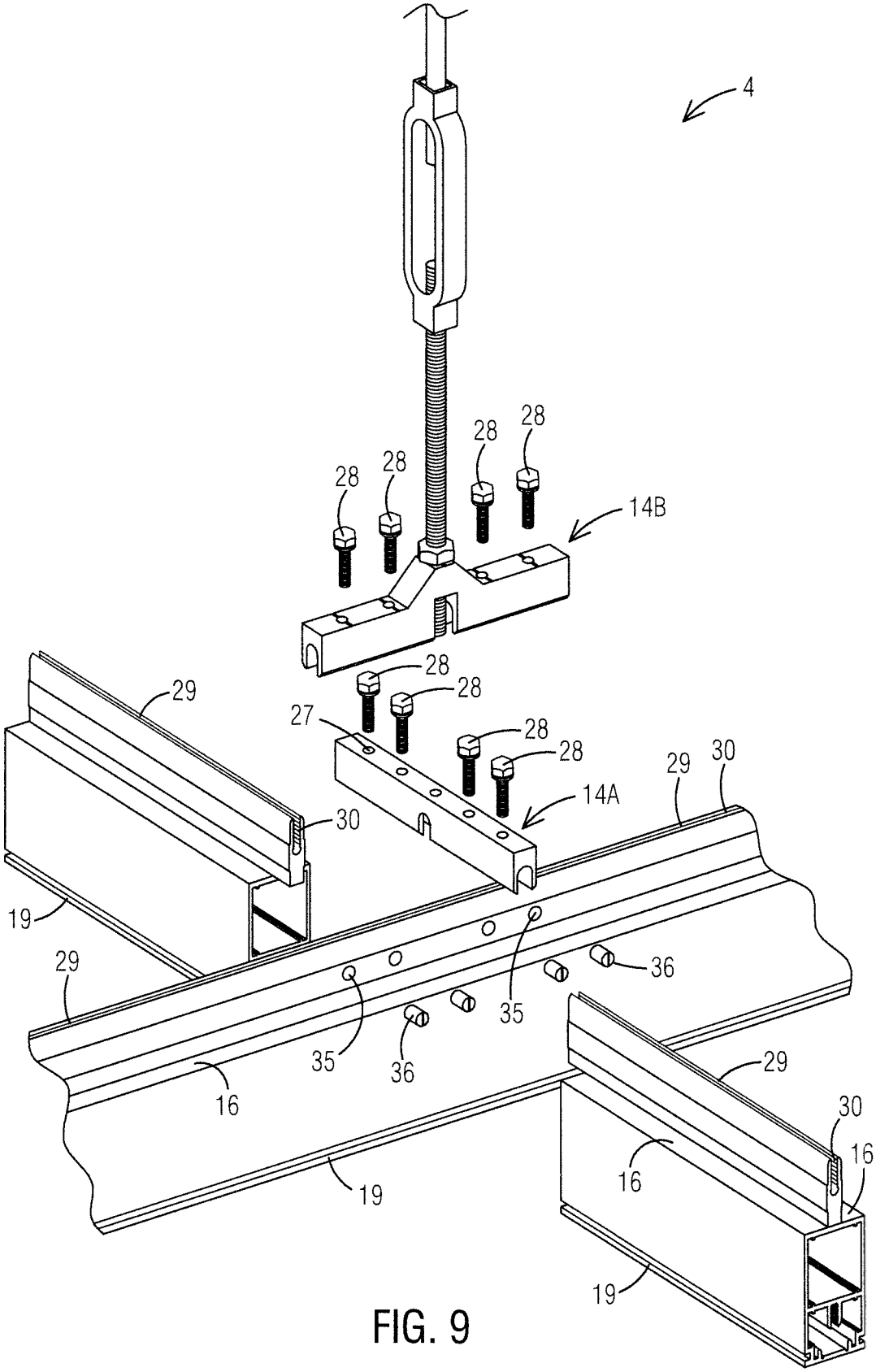
FIG. 9 is an exploded perspective view of a double crossover joint connector connected to a full/split crossover connector to form an X-shape for connecting an intersecting joint of a ceiling grid.

With general reference to FIG. 9, an exploded perspective view of a double crossover connector 14B connected to a full/split crossover connector 14A to form an X-shape for connecting an intersecting joint of a ceiling grid 15 is illustrated. The double crossover joint connector 14B and the full/split crossover connector 14A comprise apertures 27A that accept threaded fasteners 28, such as bolts, which pass through the apertures 27A to engage a beam 15A of the ceiling grid 15. The threaded fasteners 28 may engage an anchoring channel 29 located on top of the beam and having an inverted U-shape formed by two opposing side walls and screw slot extrusions 30 lining an inner surface thereof. The threaded fasteners 28 engage the screw slot extrusions 30, which act as threads within the anchoring channel 29 to maintain a screw slot firm grip on the fastener 28, thereby locking the two elements together. The joint connectors 14A and 14B may further comprise dowel nut apertures 35 that accept dowel nuts 36 that engage the threaded fasteners 28. The addition of preferably stainless-steel dowel nuts 36 into the beams 15A of the ceiling grid 15 makes the ceiling system 1 of the present invention and each suspension assembly 2 capable of carrying much heavier weights, thereby reducing the number of suspension assemblies 2 required to construct any given cleanroom ceiling.

Figure 10:
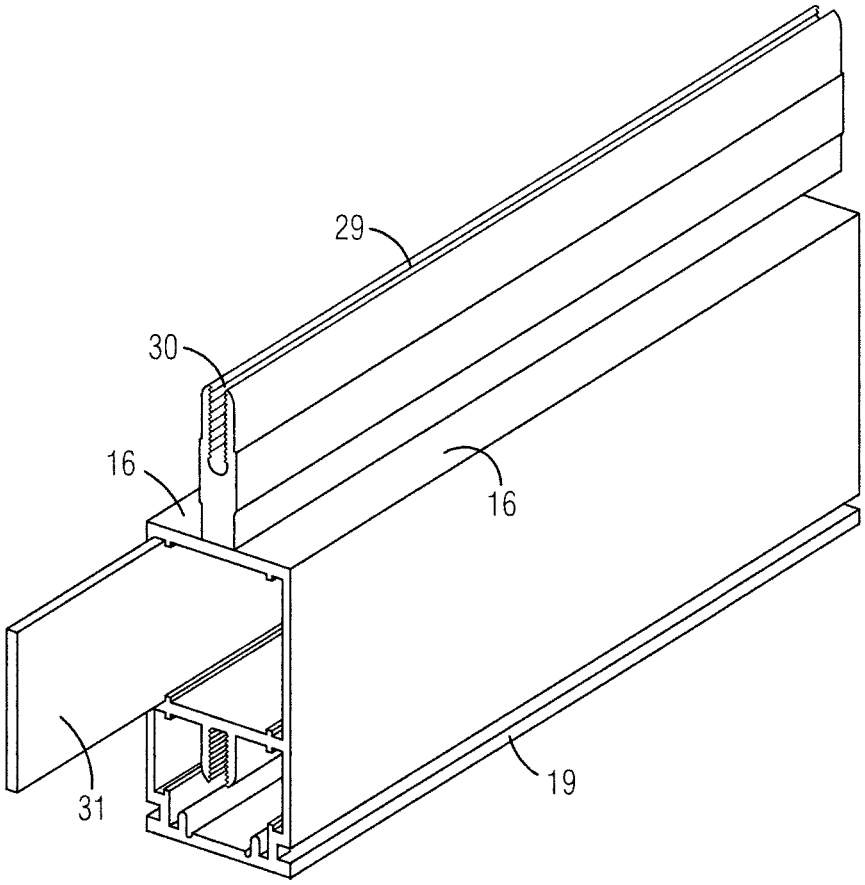
FIG. 10 a perspective side view of beams 15A of a ceiling grid 15 having a rectangular-shaped reinforcing bar

With general reference to FIG. 10, a perspective side view of beams 15A of a ceiling grid 15 having a rectangular-shaped reinforcing bar 31 is illustrated. The extruded beams 15A preferably have an inverted T-shape or L-shape that provides one or more ledges 16 for supporting edges of ceiling blanks 17, light panels, air vents, etc. Beams 15A that are joined end-to-end and further reinforced by using reinforcing bars 31. Reinforcing bars 31 may be rectangular or other have an equivalent shape that may be inserted into each end of the extruded beams 15A into corresponding slots to splice and stiffen the joint, thereby reducing the likelihood of deflection. The reinforcing bars 31 are preferably constructed out of a stainless steel or equivalent material.

With general reference to FIG. 11, a perspective side view of beams 15A of a ceiling grid 15 having a cylindrically-shaped reinforcing bar 31 is illustrated. The extruded beams 15A preferably have an inverted T-shape or L-shape that provides one or more ledges 16 for supporting edges of ceiling blanks 17, light panels, air vents, etc. beams 15A that are joined end-to-end may be further reinforced by using reinforcing bars 31. Reinforcing bars 31 may be cylindrical-shaped, tubular-shaped, or other have an equivalent shape that may be inserted into each end of the beams 15A into corresponding slots to splice and stiffen the joint, thereby reducing the likelihood of deflection. The reinforcing bars 31 are preferably constructed out of a stainless steel or equivalent material.

Figure 12:
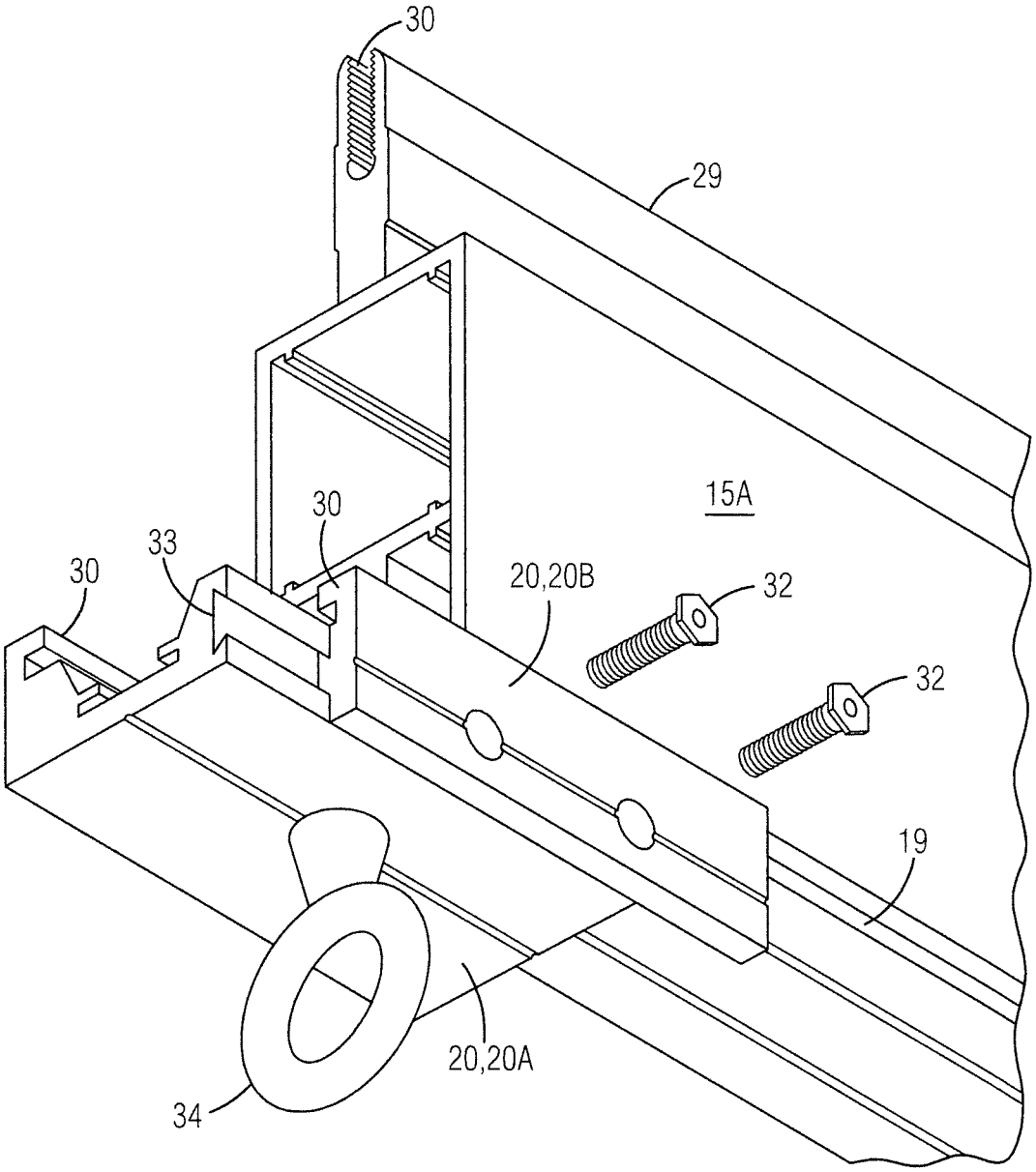
FIG. 12 is a perspective view of a ceiling support bracket having an attached utility clip.

Finally, with general reference to FIG. 12, a perspective view of an extruded beam 15 having an attached utility clip 20 is illustrated. Side attachment slots 19 or channeled grooves are located on opposing side surfaces of the extruded beam 15A and engage corresponding concave screw slot extrusions 30 on the utility clip 20 to lock the utility clip to the extruded beam 15A. As illustrated here, the utility clip 20 comprises two interlocking sides 20A and 20B that attach together using an attachment means, such as a sliding dovetail joint, screws 32, etc., to form a U-shape around the ceiling support bracket 15 and clipping into the side attachment slots 19. The utility clip 20 is preferably substantially U-shaped to provide an interior space for hiding bolt heads, nuts, wiring, and so forth. The utility clip 20 may be secured anywhere along a bottom surface of the ceiling grid assembly 13 and locked in place using a set screw 32 that engages the ceiling support bracket 15 when tightened. Likewise, the utility clip may be removed and/or repositioned by loosening the set screw 32. An eyebolt 34 or hanger rod may be attached to the utility clip 20 to provides a secondary attachment surface, thereby eliminating any need to drill into and damage the integrity of ceiling grid assembly 13.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A cleanroom ceiling system comprising:

a suspension assembly having an upper leveling assembly and a lower leveling assembly;

said upper leveling assembly having a first upper threaded rod and a first lower threaded rod connected by a first turnbuckle;

said lower leveling assembly having a second upper threaded rod and a second lower threaded rod connected by a second turnbuckle;

a top end of the first upper threaded rod being secured to a strut by a sliding nut that allows the top end of the first upper threaded rod to slide along the length of the strut and to be locked into position using at least one locking nut and washer that engage the first upper threaded rod;

a bottom end of the second lower threaded rod being secured to a plenum cap by a second sliding nut secured to the bottom end of the second lower threaded rod that allows the second lower threaded rod to slide along the length of a top channel and the plenum cap and to be locked into position using at least one locking nut and washer that engage the second lower threaded rod;

said plenum cap having a bottom channel that supports a top end of the second upper threaded rod of the lower leveling assembly wherein said top end is connected to the bottom channel by a sliding nut that allows the top end of the second upper threaded rod to slide along the length of the bottom channel and to be locked into position using at least one locking nut and washer that engage the second upper threaded rod of the lower leveling assembly; and a bottom end of the second lower threaded rod of the lower leveling assembly being attached to a full/split crossover connector and a double crossover connector that connect to form an X-shape for supporting intersecting joints of a ceiling grid.

* * * * *